US006829581B2

(12) United States Patent
Meron

(10) Patent No.: US 6,829,581 B2
(45) Date of Patent: Dec. 7, 2004

(54) METHOD FOR PROSODY GENERATION BY UNIT SELECTION FROM AN IMITATION SPEECH DATABASE

(75) Inventor: Joram Meron, Oxnard, CA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 710 days.

(21) Appl. No.: 09/918,595

(22) Filed: Jul. 31, 2001

(65) Prior Publication Data

US 2003/0028376 A1 Feb. 6, 2003

(51) Int. Cl.[7] ..... G10L 13/06
(52) U.S. Cl. ..... 704/258; 704/260; 704/266
(58) Field of Search ..... 704/258, 260, 704/266

(56) References Cited

U.S. PATENT DOCUMENTS

| | | | | |
|---|---|---|---|---|
| 6,101,470 A | * | 8/2000 | Eide et al. | 704/260 |
| 6,266,637 B1 | * | 7/2001 | Donovan et al. | 704/258 |
| 6,665,641 B1 | * | 12/2003 | Coorman et al. | 704/260 |
| 6,684,187 B1 | * | 1/2004 | Conkie | 704/260 |
| 6,697,780 B1 | * | 2/2004 | Beutnagel et al. | 704/258 |
| 6,701,295 B2 | * | 3/2004 | Beutnagel et al. | 704/258 |

OTHER PUBLICATIONS

"Generating Fo contours from ToBI labels using linear regression", A. Black and A. Hunt; ATR Interpreting Telecommunications Laboratories.

"Unit Selection in a Concatenative Speech Synthesis System Using a Large Speech Database", A. Hunt and A. Black; ATR Interpreting Telecommunications Research Labls (1996) IEEE, pp. 373–376.

"Using Decision Trees With the Tilt Intonation model to Predict Fo Contours", K. Dusterhoff, A. Black, and P. Taylor; Centre for Speech Technology Research.

"Speech Synthesis by Phonological Structure Matching", Paul Taylor and Alan W. Black; Centre for Speech Technology Research.

"Recent Improvements on Microsofts Trainable Text–to–Speech System—Whistler", X. Huang, A. Acero, H. Hon., Y. Ju, J. Liu, S. Meredith, M. Plumpe; Microsoft Research (1997) IEEE, pp. 959–962.

"Three Method of Intonation Modeling", A. Syrdal, G. Mohler, K. Dusterhoff, A. Conkie, A. Black; AT&T Labs.

* cited by examiner

*Primary Examiner*—Susan McFadden
(74) *Attorney, Agent, or Firm*—Harness, Dickey & Pierce, PLC

(57) ABSTRACT

A method is provided for prosody generation by unit selection from an imitation speech database. A rule based method of text to speech conversion is used to produce a set of intonation events by selecting syllables on which there would be either a pitch peak or dip (or a combination), and produces the parameters to generate a pitch curve of the event. The synthetic pitch curve shape generated by the rule based method is then utilized to select the best matching units from an imitation speech database of a speaker's prosody, which are then concatenated to reduce the final prosody.

12 Claims, 7 Drawing Sheets

Target sentence:

Now mo-tor-ists are paid di-rect-ly for re-pair costs.

1 2 3

Source sentences:

1) In-dus-tries will e-ven-tua-lly co-llapse if ....

2) Our he-roes then de-cide to jour-ney through the ...

3) ... co-llec-ting da-ta on rare slugs

FIG. 8

METHOD FOR PROSODY GENERATION BY UNIT SELECTION FROM AN IMITATION SPEECH DATABASE

FIELD OF THE INVENTION

The present invention relates to a process of producing natural sounding speech converted from text, and more particularly, to a method of prosody generation by unit selection from an imitation speech database.

BACKGROUND AND SUMMARY OF THE INVENTION

Text to speech (TTS) conversion systems have achieved consistent quality prosody using rule based prosody generation systems. For purposes of this application, rule based systems are systems that rely on human analysis to extract explicit rules to generate the prosody for different cases. Alternatively, corpus based prosody generation methods automatically extract the requested data from a given labeled database. The rule based synthesizer systems have achieved a high level of intelligibility, although their unnatural prosody and synthetic voice quality prevent them from being widely used in communication systems. Natural prosody is one of the more important requirements for high quality speech synthesis, to which users can listen comfortably. In addition, the ability to personalize the prosody of a synthetic voice to that of a certain speaker can be useful for many applications.

Recently, corpus based prosody modeling and generation methods have been shown to be able to produce natural-sounding prosody for text to speech systems. On the other hand, rule based prosody generation systems have the advantage of giving consistent quality prosody. Compared with the corpus based methods, the rule based method allows a conveniently explicit way of handling various prosodic effects that are not currently optimized in corpus based modeling and generation methods.

The present invention provides a method to combine the robustness of the rule based method of text to speech generation with a more natural and speaker adaptive corpus based method. The rule based method produces a set of intonation events by selecting syllables on which there would be either a pitch peak or dip (or a combination), and produces the parameters which originally would be used to generate a final shape of the event. The synthetic shape generated by the rule based method is then utilized to select the best matching units from an imitation speech database of a speaker's prosody, which are then concatenated to reduce the final prosody.

The database of the speaker's prosody is created by having the target speaker listen to a set of speech-synthesized sentences, and then imitate their prosody, while trying to still sound natural. The imitation speech is time aligned with the synthetic speech, and the time alignment is used to project the intonation events onto the imitation speech, thus avoiding the work intensive process of labeling the imitation speech database. After this processing, a database is formed of prosody events and their parameters. By using imitation speech, it is possible to reduce unwanted inconsistency and variability in the speaker's prosody, which otherwise can degrade the generated prosody. For prosody generation, a dynamic programming method is used to select a sequence of prosody events from the database, so as to be both close to the target event sequence, and as to connect to each other smoothly and naturally. The selected events are smoothly concatenated, and their intonation and duration is copied into the syllables and phonemes comprising the new sentence. The method can be used to easily and quickly personalize the prosody generation to that of a target speaker.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 8 is an example diagram of unit selection for the target sentence utilizing source sentences from which selected prosody units are chosen; and FIGS. 9*a*–9*d* illustrate the rule generator prosody for the target sentence in FIG. 9*a* with FIGS. 9*b* and 9*c* illustrating the concatenation of the selected imitation units corresponding with the rule generated unit while FIG. 9*d* illustrates the result of the concatenation and smoothing of the selected imitation units.

DETAILED DESCRIPTION OF THE PREFERRED EMBODIMENTS

The following description of the preferred embodiment(s) is merely exemplary in nature and is in no way intended to limit the invention, its application, or uses.

Figure 1:
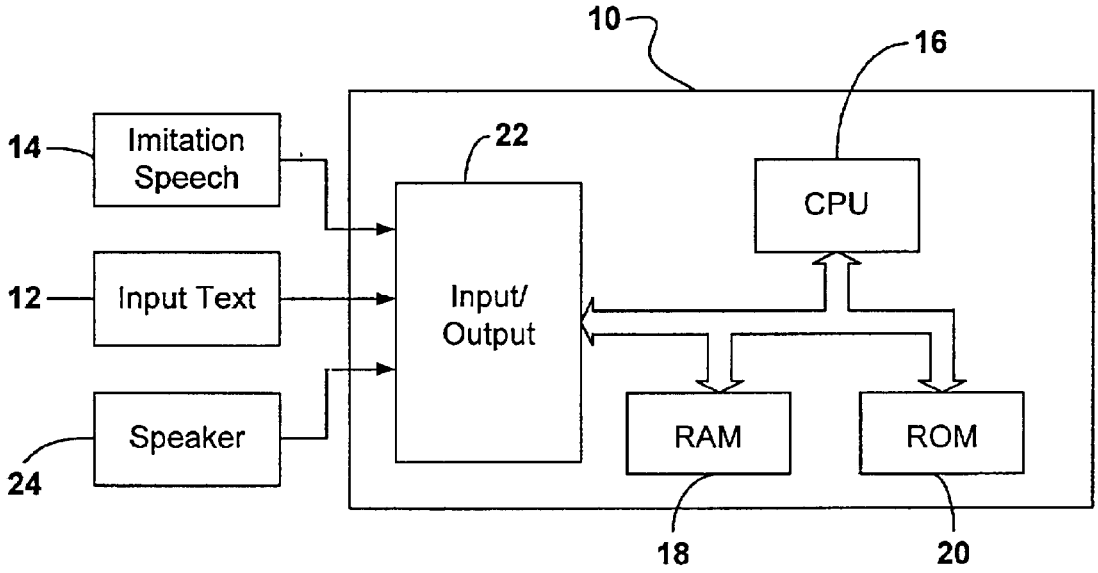
FIG. 1 is a block diagram of a text-to-speech generation system which executes the speech generation method according to the principles of the present invention.
Figure 2:
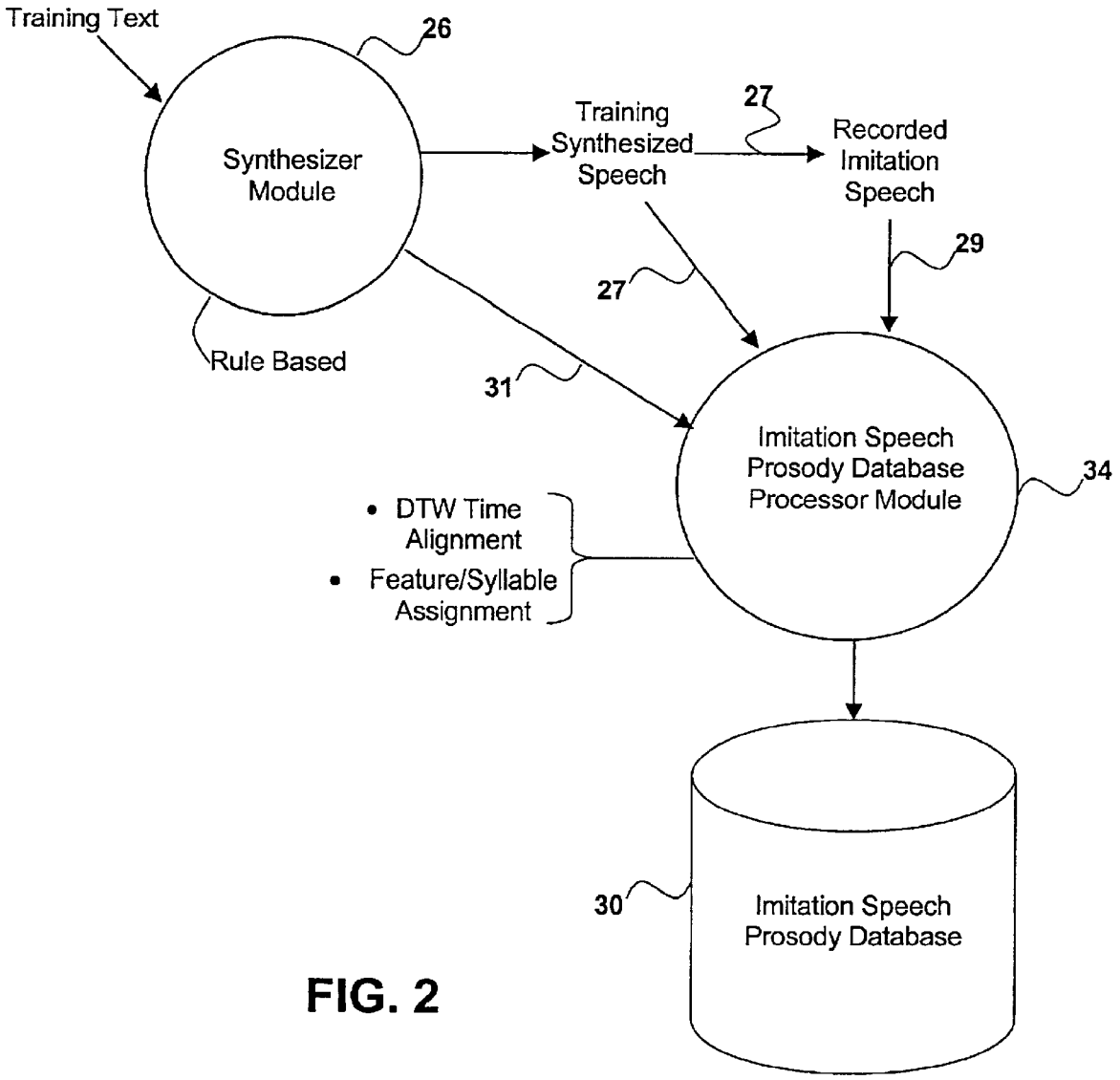
FIG. 2 is a dataflow diagram of the database training method of the present invention utilizing imitation speech according to the principles of the present invention.
Figure 5:
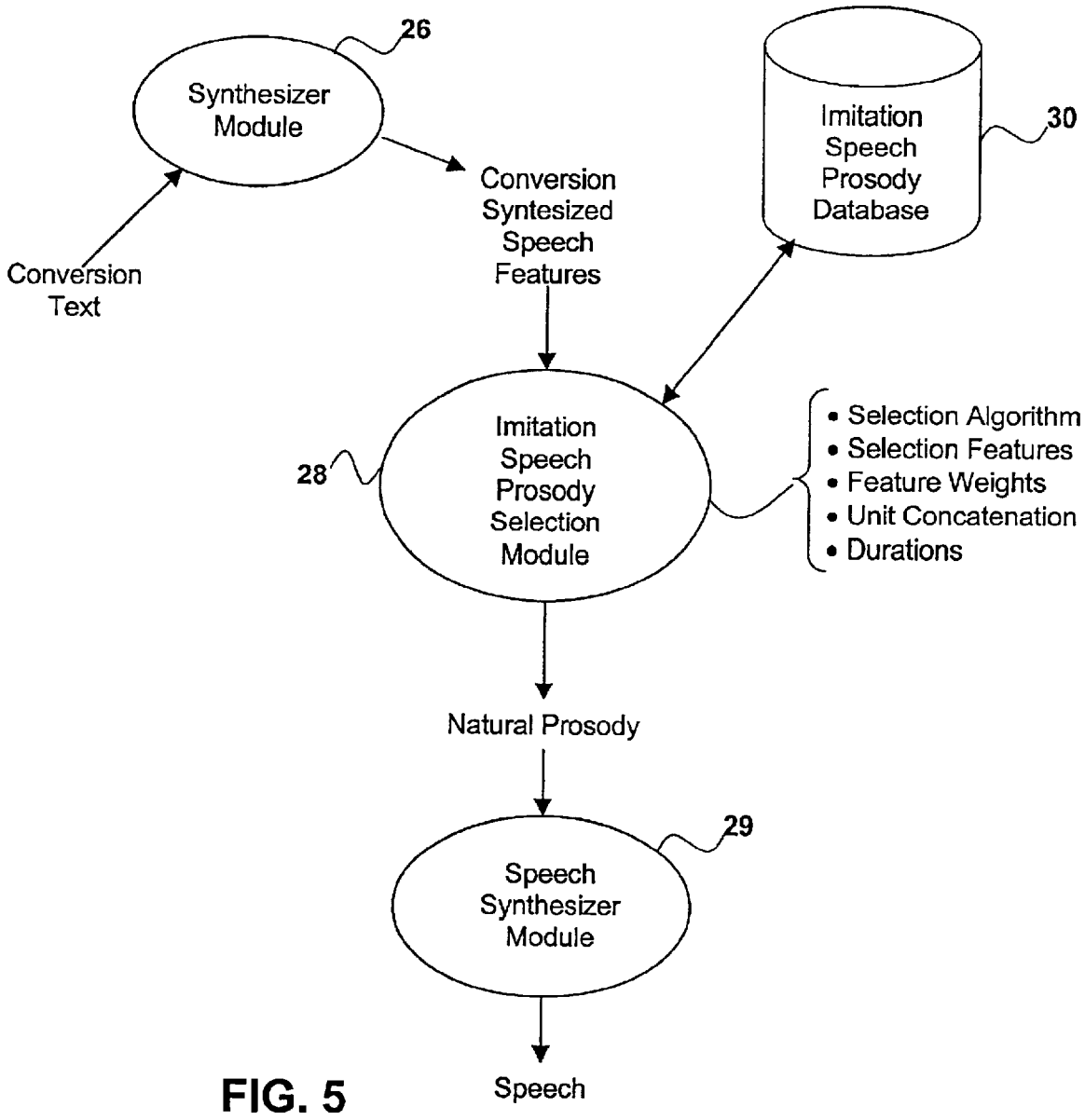
FIG. 5 is a dataflow diagram of the natural prosody speech generation method of the present invention utilizing a rule based synthesizer module and an imitation speech database.

With reference to FIGS. 1, 2, and 5, the prosody generation system utilizing unit selection from an imitation speech database will now be described. As shown in FIG. 1, the speech recognition system is employed with a computer system 10 and includes a text input system 12 for inputting text, and a transducer 14 for receiving imitation speech. The computer system 10 includes a micro computer, a digital signal processor, or a similar device which has a combination of a CPU 16, a ROM 18, a RAM 20, and an input/output section 22.

Text is input into the input/output section 22 which is then subjected to a method for prosody generation by unit selection from an imitation speech database stored in ROM 18. The computer system 10 employs a speech synthesizer method and outputs speech (with a natural prosody) to a speaker 24 representing the text to speech conversion according to the principles of the present invention. Specifically, the text is transmitted from a text input mechanism, such as a keyboard, or other text input mechanisms such as a word processor, the Internet, or e-mail, to the input/output section 22 of the computer system 10. The text is processed according to the process illustrated in FIG. 5 according to the principles of the present invention.

Referring to FIG. 5, the method for prosody generation by unit selection from an imitation speech database is illustrated. Initially, conversion text is received by the input/output section 22 of computer 10 and is then processed by a synthesizer module 26 of the CPU 16. The synthesizer module 26 provides conversion synthesized speech prosodic features to an imitation speech selection module 28 which accesses an imitation speech prosody database 30 to provide natural prosody for each syllable of the conversion synthesized speech. A speech synthesizer module 29 then provides speech generation according to a method which will be described in greater detail herein.

The imitation speech prosody database 30 is created according to a method illustrated in FIG. 2. The imitation speech prosody database 30 is created by providing training text to a synthesizer module 26 which is the same or similar to the synthesizer module 26 in FIG. 5. The synthesizer module 26 provides synthesized speech (represented by reference numeral 27) from the text that is inputted. For creating the database, a human speaker imitates the synthetic speech produced by the synthesizer module 26 and the imitation speech (represented by reference numeral 29) is recorded. Both the recorded imitation speech 29 and the training synthesized speech 27 are provided to an imitation speech prosody database processor module 34, which then generates the imitation speech prosody database 30 as will be described in greater detail herein.

Figure 3:
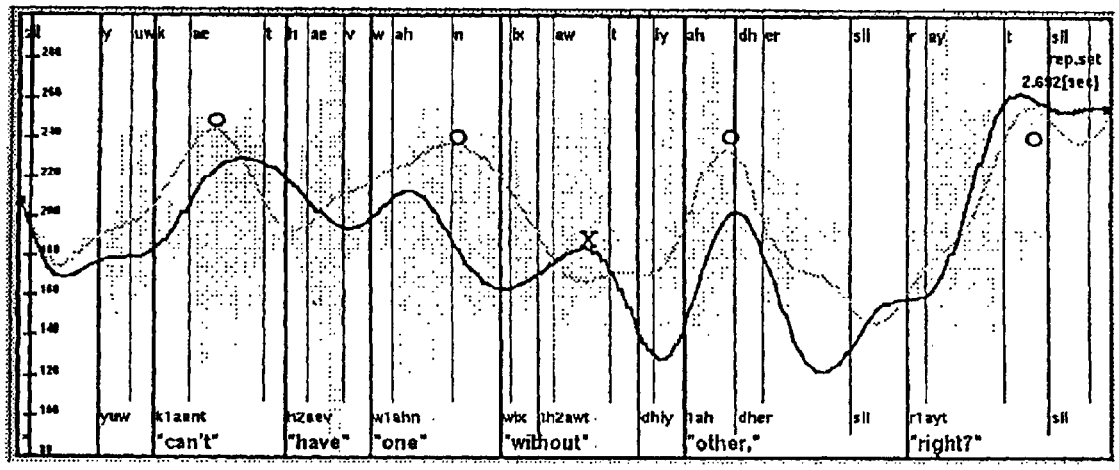
FIG. 3 is a pitch curve diagram of an example comparison of synthetic and imitation intonation used for purposes of evaluating the recording of the imitation speech.
Figure 4:
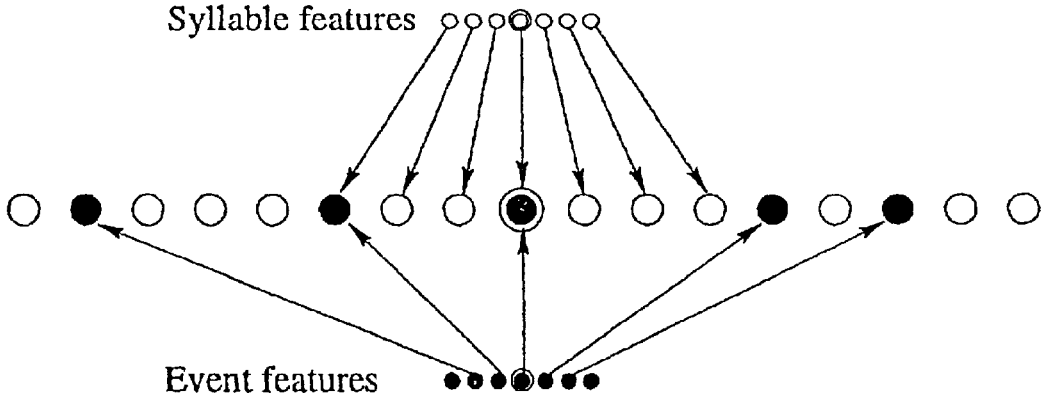
FIG. 4 is an example context feature event diagram used according to the rule based synthesizer for data processing.

With reference to FIGS. 3 and 4, the method of generating the imitation speech prosody database 30 will now be described in greater detail. For creating the database, a speaker is asked to imitate the synthetic speech produced by the synthesizer module 26. The synthesizer module 26 is a rule based synthesizer which uses a tone sequenced prosody model including pitch events, and phrase and boundary tones (each of which can get various values), and compounded with an overall declination coefficient, which sets a (declining) envelope for the pitch range as the utterance progresses. The rule based prosody synthesizer 26 is preferably of the type known in the art that uses an English language prosody labeling standard known as ToBI, which is described in *TOBI: A Standard for Labeling English Prosody*, Proc. ICSPL 92, vol. 2, p. 867–870, 1992, which is herein incorporated by reference. The ToBI rule based prosody synthesizer is generally well known in the art.

In unrestricted reading of a given text, readers may interpret the text in many different ways, producing a large variation in their speech prosody. By imitating the synthesizer, the problem of unknown interpretation is reduced (at least to the degree the speaker was able to imitate the synthesizer), as the synthesizer produces the interpretation. The important factor is that the interpretation is fixed, known, and described by a set of concrete, unambiguous values contained in the dynamic internal data structures of the synthesizer. This additional knowledge is used to improve the quality of the generated prosody.

The trained database is created by synthesizing speech 27 by the rule based system and then asking a reader to imitate the training synthesized speech. The reader is asked to preserve the nuance of the utterance as spoken by the synthesizer and to follow the location of the peaks and dips in the intonation while trying to still sound natural. In other words, the reader is asked to use the same interpretation as the synthesizer, but to produce a natural realization of the prosody.

The speaker sees the text of the sentence, hears it synthesized two to three times, and records it. The speaker can repeat this process as many times as necessary in order to obtain a close match to the synthesized training speech. Training text can be randomly or selectively chosen with the restriction that each sentence should not be too long (about ten words per sentence and preferably not exceeding fifteen words), as longer sentences are more difficult to imitate.

The quality of the recorded imitations can be evaluated and if found unacceptable, can be discarded and/or replaced. The recordings can be evaluated, for example, by native listeners who confirm that the speech did not sound unnatural or strange in any way. The recorded speech 29 can also be evaluated for how close the imitation speech is to the original synthesized speech 27 that was being tested. The time aligned, low pass filtered pitch curves of the synthetic and imitation utterances can be manually compared while being reviewed for two kinds of errors. The errors include "misses" which are identified for a syllable with an assigned event in the synthesized speech 27, where the imitation did not follow the original movement, i.e., no event. Another type of error includes "insertions" which are identified for a location without an assigned event in the synthetic speech 27 where there is a significant pitch movement which can be identified in the imitation speech 29.

As shown in FIG. 3, an example comparison of the synthetic (dashed curve) and imitation (solid curve) intonations are illustrated. The O's mark locations with intonation events generated by the rule system. If there was a similar movement in the imitation speech in the same syllable, it is counted as a match. Notice the additional movement inserted by the speaker marked by an X which represents an insertion. In case the speaker made errors in imitating the synthetic prosody, it is possible to manually correct the extracted prosody of the speaker to better match the synthetic prosody.

In addition to the recorded imitation speech, the database 30 includes the information extracted from the synthesizer's internal data for each sentence. This data is stored as feature vectors (represented by reference numeral 31) including both syllable and intonation event features. For each intonation event, one (context inclusive) feature vector is added to the database. The feature vectors 31 preferably contain the following data (also including the values for neighboring events and syllables):

EVENT FEATURES: a type of event (pitch, phrase, boundary, or a combination in case one syllable was assigned more than one event), part of speech (of respective word), and the parameters of the event (type and target amplitude).

SYLLABIC INFORMATION: syllable segmental structure, syllable stress, part of speech, duration, average F0 and F0 slope.

OTHER: the declination value at the event, and the sentence type.

Some of the values in the feature vectors 31 are associated with events, while others are associated with syllables. The feature vector for each event contains the features corresponding to that event, but also the features for a context window around that point. This context window can either contain feature values for neighboring syllables, or for neighboring events as illustrated in FIG. 4. These two types of feature contexts allow to catch both local and a somewhat more global context around each event.

After the training database is recorded, each recorded utterance is time aligned to its synthetic version (using dynamic time warping, as is known in the art), and its pitch is extracted. The time alignment automatically obtains an approximate segmental labeling for the recorded imitation speech. The fact that the speaker was imitating the synthesizer, helps the dynamic time warping aligner to produce fairly accurate results. Using this alignment, the features extracted from the recorded imitation speech (F0, duration) are assigned to their associated syllables. After values are assigned to all of the syllables, the final feature vectors (including context) are created for syllables in which intonation events occur (according to the rule based system).

According to the present invention, the data processing is done completely automatically with manual supervision only during recording. Specifically, no prosodic labeling or segmental labeling is necessary if the imitation speech is done appropriately so that the dynamic time warping aligner can produce accurate results. Thus, the final feature vectors that are created for the syllables in which intonation events occur, are saved as the imitation speech prosody database 30.

Using the imitation speech database 30, the method as illustrated in FIG. 5 is then carried out for converting text to natural prosody speech which will now be described in greater detail with reference to FIGS. 5–9. As discussed above, the conversion text (text which is desired to be converted into natural prosody speech) is provided to a synthesizer module 26, preferably of the rule-based type discussed above. The synthesizer module 26 provides a conversion synthesized speech to the imitation speech prosody selection module 28. The imitation speech prosody selection module 28 utilizes a selection algorithm for intonation event selection. The algorithm uses a Viterbe-like dynamic programming method to find a minimum cost path across a graph so that the selected units are both close to the given target and smoothly connectable to each other. The cost function is a sum of distortion costs (representing the match between a candidate unit and a target unit), and concatenation cost (the match between a candidate unit and a candidate for a previous unit).

Before the selection is performed, the rule based system of synthesizer module 26 processes the text and decides where to place events and creates feature vectors for these events. The selection module 28 then finds the best matching unit sequence from the database 30. The position of the events fixes the way the database units will be used (how many syllables around the actually selected events will be taken and used).

Figure 6:
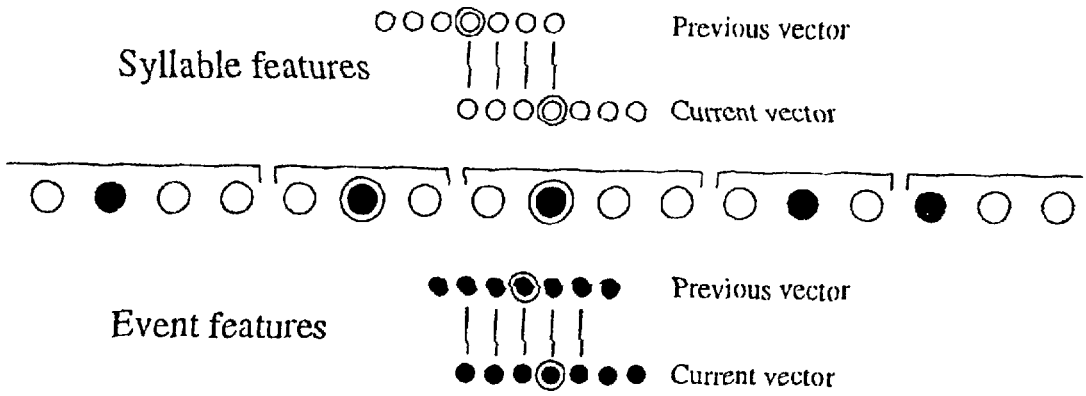
FIG. 6 is an example diagram of the handling of the different context types present in the feature vectors according to the principles of the present invention.

FIG. 6 illustrates a calculation of the concatenation costs in the selection algorithm between two feature vectors (for the two circled syllables with events), i.e., the feature context windows are compared with different shift for the syllable and event features, as shown by the connecting lines. The lines above the syllables in the middle of the figure show the grouping of the syllables (which event these syllables will actually be taken from). The basic features extracted for each of the sentences in the training database 30 are used for calculating the selection processes distortion and concatenation cost. During the selection process, the calculation of the concatenation cost needs to take into account the two different types of context (syllables/events) present in the feature vectors. FIG. 6 illustrates the handling of the different context types: the shift of index and feature vectors belonging to two consecutive events, is one for event context features, and for the syllable context, it is the distance (number of syllables), between the two events (for the example shown in FIG. 6).

The features used by the selection are:

DISTORTION—Syllable: syllable synthetic duration, syllable synthetic F0, event type (can be none), syllable structure, syllable stress, declination value at syllable, event target amplitude (can be none), syllable is silence.

DISTORTION—Event: event type, declination value, target event amplitude, sentence type.

CONCATENATION—Syllable: synthetic and natural F0 and duration, event type (can be none), declination value at syllable, syllable structure and stress, syllable is silenced.

CONCATENATION—Event: event type, target event amplitude, declination value.

A similar selection algorithm, applied for segmental unit selection, is described in the article *Unit Selection in a Concatenative Speech Synthesis System Using a Large Speech Database*, Proc. ICASSP 96, vol. 1, p. 373–376, Atlanta, Ga., 1996 by A. Hunt and A. Black, which is herein incorporated by reference.

As in the above-referenced article by Hunt and Black for waveform units, one of the problems with the selection algorithm is the setting of the relative weights for each of the features, i.e., trying to determine the relative importance of each feature. With a smaller size training database, the setting of the weights can be manually set or can be statistically set in order to optimize the feature weights. The different features used for the selection may be assigned weights, so as to adjust their relative importance in determining the selected units. These weights can be set either manually (in a heuristic way), or by a data driven approach.

The generation of the final prosody is done by concatenating natural prosody units extracted from the recorded imitation speech. Each syllable in the synthetic sentence is associated with an event as shown in FIG. 6. The prosody for the sequence of syllables is associated with a target event and is taken from the sequence of syllables in the same relative position to the corresponding selected event. The copying of the pitch is done in a syllable-by-syllable way, scaling the pitch contour of the selected syllable into the duration of the target syllable. An alternative way to generate the pitch is to divide the selected and target syllables into three parts (pre-vowel, vowel and post-vowel). The pitch is copied in a piecewise linear way between corresponding parts. For example, from the selected unit's pre-vowel part to the target pre-vowel part, etc.

Figure 7:
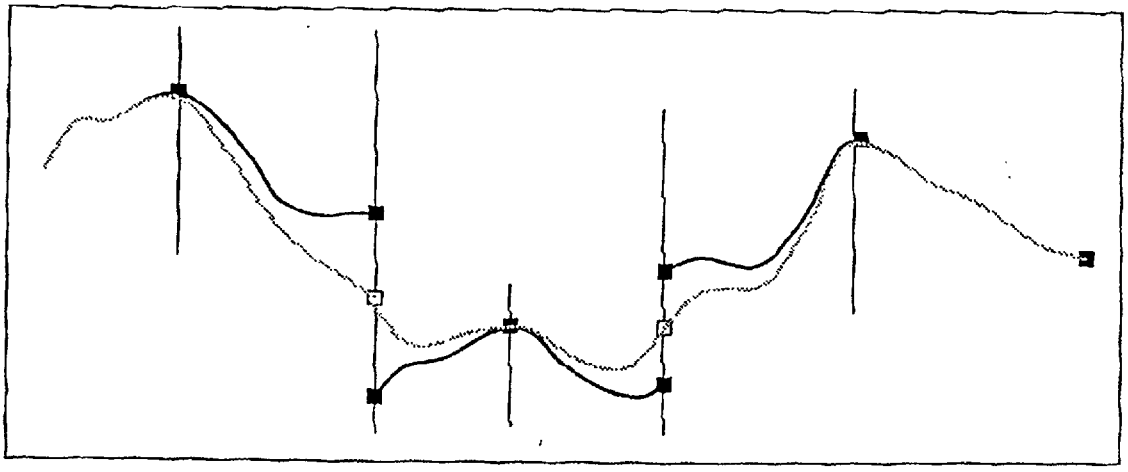
FIG. 7 illustrates an example of FO smoothing which is performed to avoid discontinuities at the concatenation points between two prosodic units according to the principles of the present invention.

In order to avoid F0 discontinuities at the concatenation points between two prosodic units, an F0 smoothing is performed as shown in FIG. 7 (in which the pitch curve for the unit is shown as solid and the smoothed pitch curve is shown as a dotted line). The F0 at the concatenating point is set to the middle value of the discontinuity, and a linearly increasing offset is added to each unit so that the unit's middle F0 is not changed. The edge F0 is set to the middle value between the adjacent edges. An additional smoothing is applied in a case where a syllable is assigned a "wild" pitch movement which can occur as a result of copying the pitch from a long syllable with strong pitch movement into a significantly shorter syllable. To avoid this "wild" pitch movement, the system automatically flattens the pitch movement whenever the duration of a syllable is shortened by a factor greater than a threshold value such as 2.0.

Segmental duration can also be modified by values taken from the selected units. In a preferred embodiment, however, the duration of each of the syllable's phonemes is copied from the selected unit. Where the speaker of the imitation speech imitated the rhythm as well as the intonation, the use of the recorded duration with no further normalization is beneficial in order to simplify the system. A benefit of this duration copying is that when trying to synthesize a sentence which is included in the training database, its prosody will be directly copied from the original, which is a useful feature for a domain specific synthesizer.

Figure 9:
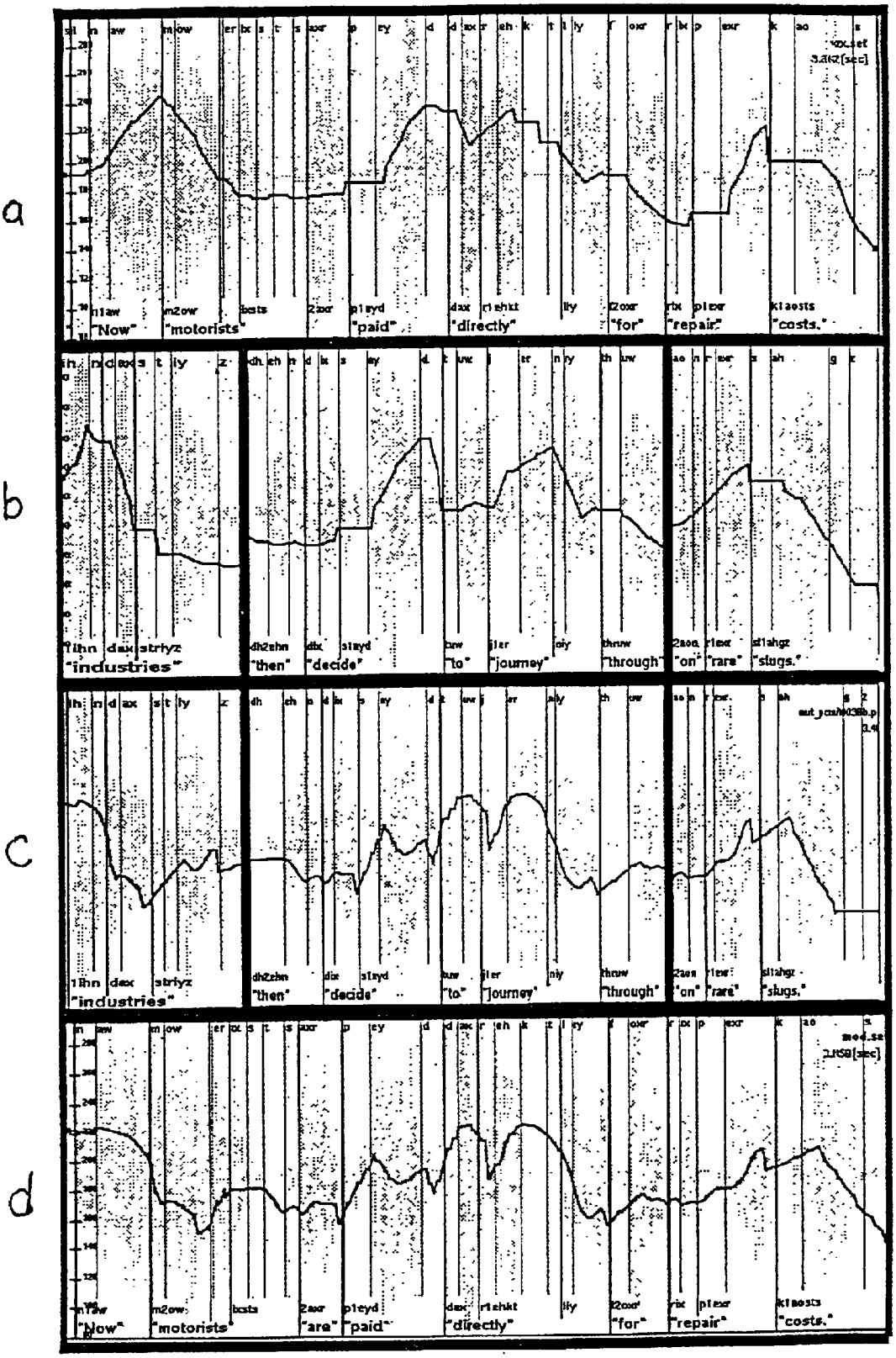

FIGS. 8 and 9 show an example run of the unit selection prosody generation. First, the rule based system is run on the target sentence ("Now motorists are paid directly for repair costs") shown in FIG. 8. The system analyzes the text and places intonation events on appropriate syllables (marked with dots in FIG. 8). Each syllable of the sentence is associated with one event (marked with brackets above the target sentence in FIG. 8). The selection process then selects the best matching units from the database. In this case, the selection shows three consecutive unit sequences (marked by underlining under the target sentence in FIG. 8), taken from the marked parts in the source sentences. FIG. 9*a* shows the rule generated prosody for the target sentence. FIG. 9*b* shows the concatenation of the selected units, i.e., the rule generated units. FIG. 9*c* shows the imitation units (note that in this display, no time alignment was performed within each consecutive part). The concatenation points between consecutive parts are marked by the thick vertical lines. FIG. 9*d* shows the result of concatenation and smoothing of the selected imitation units. It is the waveform of speech of FIG. 9*d* that is then utilized by the computer 10 to provide audible speech that sounds more like natural human speech.

The present invention can be used to produce highly natural prosody with small memory requirements. Especially for limited domain synthesis, a sentence which occurred in the training database (or a part of it, e.g. frame sentence) would be assigned its natural prosody. The method uses only natural prosody, not relying on any modifications or modeling, which may degrade the naturalness of the generated prosody. By using imitation speech, the produced prosody database can be made to be more consistent, avoiding the concatenation of dissimilar units to each other. In addition, imitation speech helps reduce errors in the automatic labeling of the recorded speech. The method can be used to easily and quickly personalize the prosody generation to that of a target speaker. It is also possible to use the selection prosody only for part of a sentence. For example, leaving part of the sentence unchanged (as it was produced by the rule prosody) and using the selection prosody only for some of the syllables such as only the last syllables.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A computer implemented method for prosody generation, comprising the steps of:

preparing an imitation speech database using recordings of natural human speech;

converting text to synthesized speech using a rule based speech synthesizer;

selecting prosody units from said imitation speech database to match said synthesized speech; and concatenating said selected prosody units and generating a final prosody.

2. The method according to claim 1, wherein said rule based computer synthesizer uses a tone sequence prosody model.

3. The method according to claim 1, wherein said step of selecting prosody units from said imitation speech prosody database includes a cost function algorithm using distortion and concatenation costs.

4. The method according to claim 1, wherein said step of selecting prosody units from said imitation speech prosody database includes associating each syllable in said synthesized speech with an event including pitch events.

5. The method according to claim 1, wherein said step of concatenating said selected prosody units and generating a final prosody includes an F0 smoothing function performed at concatenation points between selected prosody units.

6. A computer implemented method for prosody generation, comprising the steps of:

preparing an imitation speech prosody database including:

converting training text to synthesized speech using a rule based computer synthesizer;

recording human speech imitating said synthesized speech;

time aligning said recorded human speech with said synthesized speech and extracting features from said recorded speech for syllables in which intonation events occur and generating said imitation speech prosody database; and generating speech prosody from text including:

converting text to synthesized speech using a rule based synthesizer;

selecting prosody units from said imitation speech prosody database to match said synthesized speech; and concatenating said selected prosody units and generating a final prosody.

7. The method according to claim 6, wherein said rule based synthesizer uses a tone sequence prosody model.

8. The method according to claim 6, wherein said step of selecting prosody units from said imitation speech prosody database includes a cost function algorithm using distortion and concatenation costs.

9. The method according to claim 6, wherein said step of selecting prosody units from said imitation speech prosody database includes associating each syllable in said synthesized speech with an event including pitch events.

10. The method according to claim 6, wherein said step of concatenating said selected prosody units and generating a final prosody includes an F0 smoothing function performed at concatenation points between selected prosody units.

11. The method according to claim 6, wherein said step of time aligning said recorded human speech with said synthesized speech is performed using a dynamic time warp aligner.

12. A speech generation processor for processing input text to speech, comprising:

an imitation speech database including prosodic units from imitation speech;

a rule based synthesizer module for generating synthesized speech curves for input text;

an imitation speech prosody selection module for selecting prosodic units from said imitation speech database with said synthesized speech curves and concatenating said selected prosodic units together for speech generation; and an audible device for receiving a speech generation signal from said imitation speech prosody selection module and generating audible speech.

* * * * *